US006890168B2

(12) United States Patent
Kim

(10) Patent No.: US 6,890,168 B2
(45) Date of Patent: May 10, 2005

(54) BIAXIAL PRESS MOLDING SYSTEM

(76) Inventor: Young-Jung Kim, 112-1102 Sammaeul Apt., 1121 Hogye-dong, Dongan-gu, Anyang-city, Kyungki-do (KR), 431-080

( * ) Notice: Subject to any disclaimer, the term of this patent is extended or adjusted under 35 U.S.C. 154(b) by 130 days.

(21) Appl. No.: 10/220,415

(22) PCT Filed: Mar. 3, 2001

(86) PCT No.: PCT/KR01/00324

§ 371 (c)(1),
(2), (4) Date: Aug. 30, 2002

(87) PCT Pub. No.: WO01/66337

PCT Pub. Date: Sep. 13, 2001

(65) Prior Publication Data

US 2003/0029335 A1 Feb. 13, 2003

(30) Foreign Application Priority Data

Mar. 4, 2000 (KR) ..... 2000-10883

(51) Int. Cl.[7] ..... B29C 43/36

(52) U.S. Cl. ..... 425/78; 425/345; 425/353; 425/DIG. 5

(58) Field of Search ..... 425/78, 344, 345, 425/352, 353–354, 122, DIG. 5

(56) References Cited

U.S. PATENT DOCUMENTS 2,970,485 A 2/1961 Frank
3,999,922 A * 12/1976 Shimada ..... 425/345
4,047,866 A * 9/1977 Shah ..... 425/354
4,057,381 A * 11/1977 Korsch ..... 425/345
5,686,118 A * 11/1997 Kurata ..... 425/122
5,906,837 A * 5/1999 Link et al. ..... 425/78

* cited by examiner

*Primary Examiner*—Tim Heitbrink
*Assistant Examiner*—Thu Khanh T. Nguyen
(74) *Attorney, Agent, or Firm*—Volpe and Koenig, P.C.

(57) ABSTRACT

A biaxial press molding system includes a cam apparatus having cams facing each other, and a biaxial press apparatus, disposed between the cams and installed to be capable of sliding contacting the cams, for forming a biaxial pressure to a molding object by converting rotational motion of the cams to linear reciprocating motion. Thus, a repulsive force generated during pressing concentrates only on the rotation shaft, so that an optimal design of the frame and a light system are possible. The upper and lower pressure continuously applied to a pressed object can be changed and the maximum pressure can be freely maintained, increased and decreased by forming upper and lower portions at the frictional surfaces of the cams facing each other. Also, a fine control of pressure is possible, the pressure can be appropriately distributed according to part of the pressed object, and mass production of accurate molding products is possible by controlling the pressing point of time.

9 Claims, 10 Drawing Sheets

BIAXIAL PRESS MOLDING SYSTEM

BACKGROUND OF THE INVENTION

1. Field of the Invention

The present invention relates to a biaxial press molding system, and more particularly, to a biaxial press molding system in which rotation motion is converted to linear motion by using disc type cams facing each other and a repulsive force generated during the conversion is applied to a rotating plate and a rotation shaft so that the strength and load of a frame can be reduced.

2. Description of the Related Art

In general, a press is a machine for pressing a molded object by changing rotation motion of a motor to a linearly reciprocating motion. The press is designed such that the strength and load of a frame according to pressure applied to the molded object is reinforced. In particular, in molding apparatuses using the conventional presses, a motor rotates a cam and a punch is installed at a mobile body linearly reciprocating corresponding to the rotating cam, so that the punch hits a molded object placed on a die of the frame.

Accordingly, since an instantaneous impact amount or pressing force of the punch concentrates on the frame only, the frame is damaged or excessive noise and vibrations are generated. To prevent these problems, the weight of the frame is increased and the strength is reinforced during design of the press.

Thus, the molding apparatuses using the conventional presses require very huge and heavy frames so that a lot of manufacturing cost is needed. Also, a lot of manpower and time is needed when the frame is installed, disassembled or repaired. Also, the conventional molding apparatus uses a method of moving a die plate to generate up and lower pressures. However, accurate control of the upper and lower pressures is not possible and mechanism thereof becomes complicated. As a result, the total size of the press increases.

Furthermore, since the conventional molding apparatus uses an eccentric cam in which the center axis and the rotation axis are eccentric to convert the rotation motion of the cam to linearly reciprocating motion, only a point of time that is the pressure at the maximum point can be controlled while a change in continuously changing pressure cannot be controlled.

SUMMARY OF THE INVENTION

To solve the above-described problems, it is an object of the present invention to provide an upper and lower biaxial press molding system in which a repulsive force generated during pressing concentrates only on the rotation shaft, so that an optimal design of the frame and a light system are possible, the upper and lower pressure continuously applied to a pressed object can be changed and the maximum pressure can be freely maintained, increased and decreased by forming upper and lower portions at the frictional surfaces of the cams facing each other, a fine control of pressure is possible, the pressure can be appropriately distributed according to part of the pressed object, and mass production of accurate molding products is possible by controlling the pressing point of time.

To achieve the above object, there is provided a biaxial press molding system comprising a cam apparatus having cams facing each other, and a biaxial press apparatus, disposed between the cams and installed to be capable of sliding contacting the cams, for forming a biaxial pressure to a molding object by converting rotational motion of the cams to linear reciprocating motion.

It is preferred in the present invention that the cam apparatus comprises a frame, a motor fixed to the frame, a reduction driven gear for transferring a rotational force of the motor, a rotation shaft rotating at a speed decelerated by the reduction driven gear and being supported at the frame via a bearing, a joint for connecting the reduction driven gear and the rotation shaft, an upper disc cam including a disc type upper cam base formed at the upper end portion of the rotation shaft and a ring type upper track member screw-coupled to the lower surface of the upper cam base and having upper and lower portions formed on the lower surface thereof, and a lower disc cam including a disc type lower cam base formed at the lower end portion of the rotation shaft and a ring type lower track member screw-coupled to the upper surface of the lower cam base and having upper and lower portions formed on the upper surface thereof.

It is preferred in the present invention that the biaxial press apparatus comprises an upper roller moving body in which a roller contacting the upper and lower portions of the upper track member of the upper disc cam is installed on the upper surface thereof and a through hole is formed at each of both end portions thereof so that the upper roller moving body freely moves up and down along a guide rod fixed to the frame, an upper punch moving body in which a screw assembly for adjusting pressure and the distance from the upper roller moving body is installed on the upper surface thereof, a through hole is formed at each of both end portions so that the upper punch moving body freely moves up and down along the guide rod fixed to the frame, and an upper punch is fixed to the lower surface thereof, an upper elastic member installed between the frame and the upper punch moving body for applying a return force in a direction in which the upper punch moving body ascends, a core passing through the center of the lower punch and fixed to the frame to be capable of the height thereof being adjusted, a lower roller moving body in which a roller contacting the upper and lower portions of the lower track member is installed on the lower surface thereof and a through hole is formed at each of both end portions thereof so that the lower roller moving body freely moves up and down along the guide rod fixed to the frame, a lower punch moving body in which a screw assembly for adjusting pressure by adjusting the distance from the lower roller moving body is installed on the lower surface thereof, a through hole is formed at each of both end portions so that the lower punch moving body freely moves up and down along the guide rod fixed to the frame, and a lower punch is fixed to the upper surface thereof; and a lower elastic member installed between the frame and the lower roller moving body for applying a return force in a direction in which the lower punch moving body ascends.

It is preferred in the present invention that the upper and lower portions of each of the upper and lower track members is manufactured according to the point of generation of biaxial pressure and the amount of pressure required for a molding object, the upper and lower portions is formed at the lower track member for demolding of a molding object and filling with material for molding, and a height adjustment unit of the cam where the upper and lower portions is formed is further provided.

It is preferred in the present invention that the biaxial press molding system further comprises a molding object supply unit for supplying material for molding to the die.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Hereinafter, the biaxial press molding system according to a preferred embodiment of the present invention will not be described with reference to the attached drawings.

Figure 1:
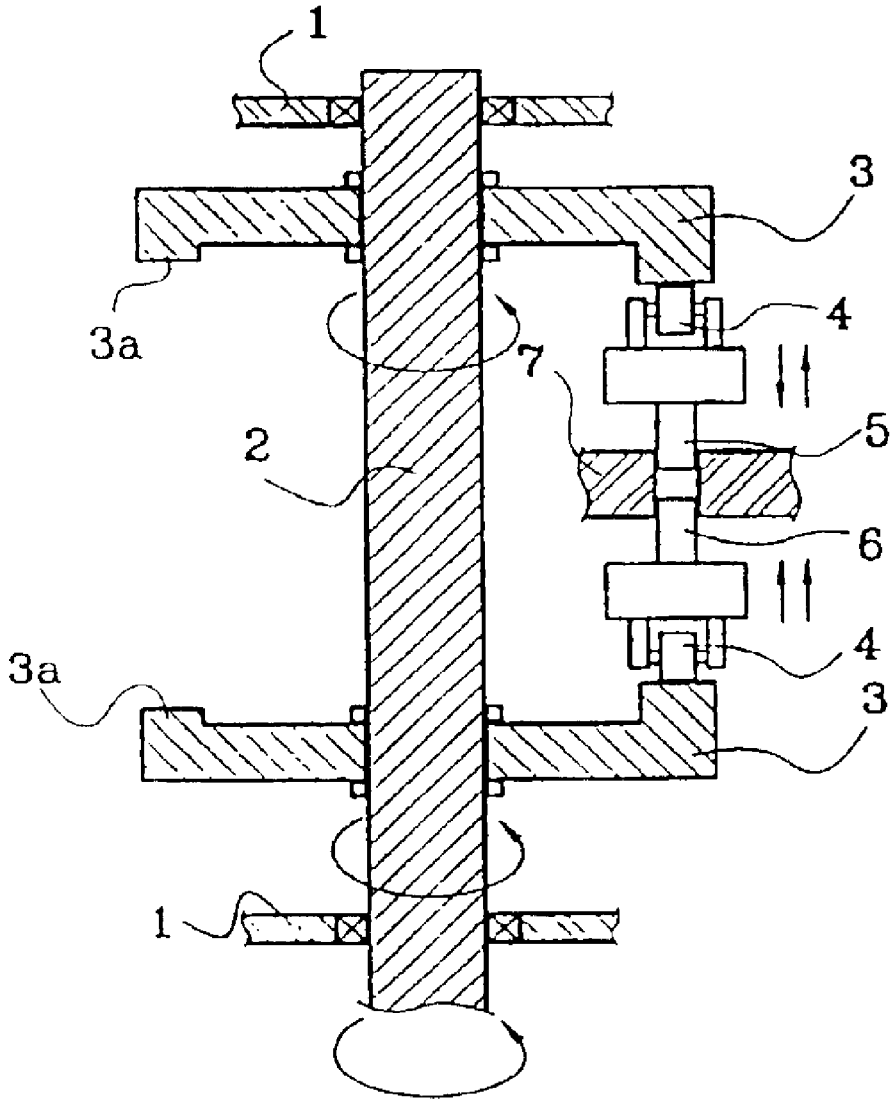
FIG. 1 is a schematic view showing the concept of a biaxial press molding system of the present invention.

First, as shown in FIG. 1, but not limited thereto, the biaxial press molding system according to the present invention is based on the technical concept of converting rotational motion of cams 3 rotatably supported at a frame 1 and installed at the same rotation shaft 2 facing each other to linearly reciprocating motion of an upper punch 5 and a lower punch 6 contacting each of the cams 3 through rollers 4.

Here, the two facing cams 3 are discs. A contact surface between each cam 3 and each roller 4 is a lower surface or an upper surface of the cams 3 facing each other, not the circumferential surfaces of the cams 3.

That is, each cam 3 is in contact with each roller 4 to make a right angle. The contact surfaces formed on the lower surface and the upper surface of the disc type cams 3 have steps 3*a* on which upper and lower portions are formed along the circumferential direction. Thus, as each cam 3 rotates, each roller 4 capable of moving up and down only moves up and down while contacting the upper and lower portions along the track of each step 3*a*.

Thus, when the rotation shaft 2 is rotated by a motor (not shown), the upper punch 5 and the lower punch 6 perpendicularly move up and down so that biaxial pressure can be applied to the upper and lower sides of an object to be pressed that is inserted in a die 7. Here, by manufacturing various shapes of the upper and lower portions formed on the steps 3*a*, the upward and downward motions of the upper punch 5 and the lower punch 6 can be respectively controlled.

Here, the cams 3 are disc types and the rotation shaft 2 is formed at the center of each cam 3 so that the center of the rotation shaft 2 and the center of each disc cam 3 are matched. Thus, since no repulsive force due to eccentricity is generated during rotation, when the upper punch 5 and the lower punch 6 are operated, the load applied to the rotation shaft 2 applies only to the rotation shaft 2 via the cams 3. As a result, only a small amount of pressure is applied to the outside frame.

Therefore, the biaxial press molding system according to the present invention can be installed with only very light and optimal frame so that manufacturing cost can be reduced. Also, man power and time can be much reduced and saved when the present biaxial press molding system is installed, disassembled or repaired.

Also, since the cams 3 are rotated by the same motor around the same rotation shaft 2, the time for generating upper and lower pressures can be easily changed by adjusting the height of the mountain of each cam 3, and the pressures can be maintained for an appropriated time at the maximum point, which is quite distinguished from a general cam press.

In particular, in the case of products of which size is changed by the subsequent process such as sintering after molding, the pressure of molding according to part thereof can be controlled so that changes in pressure per position and time applied to the upper surface and lower surface of an object to be molded can be finely controlled. Thus, the quality of the product can be improved.

Figure 2:
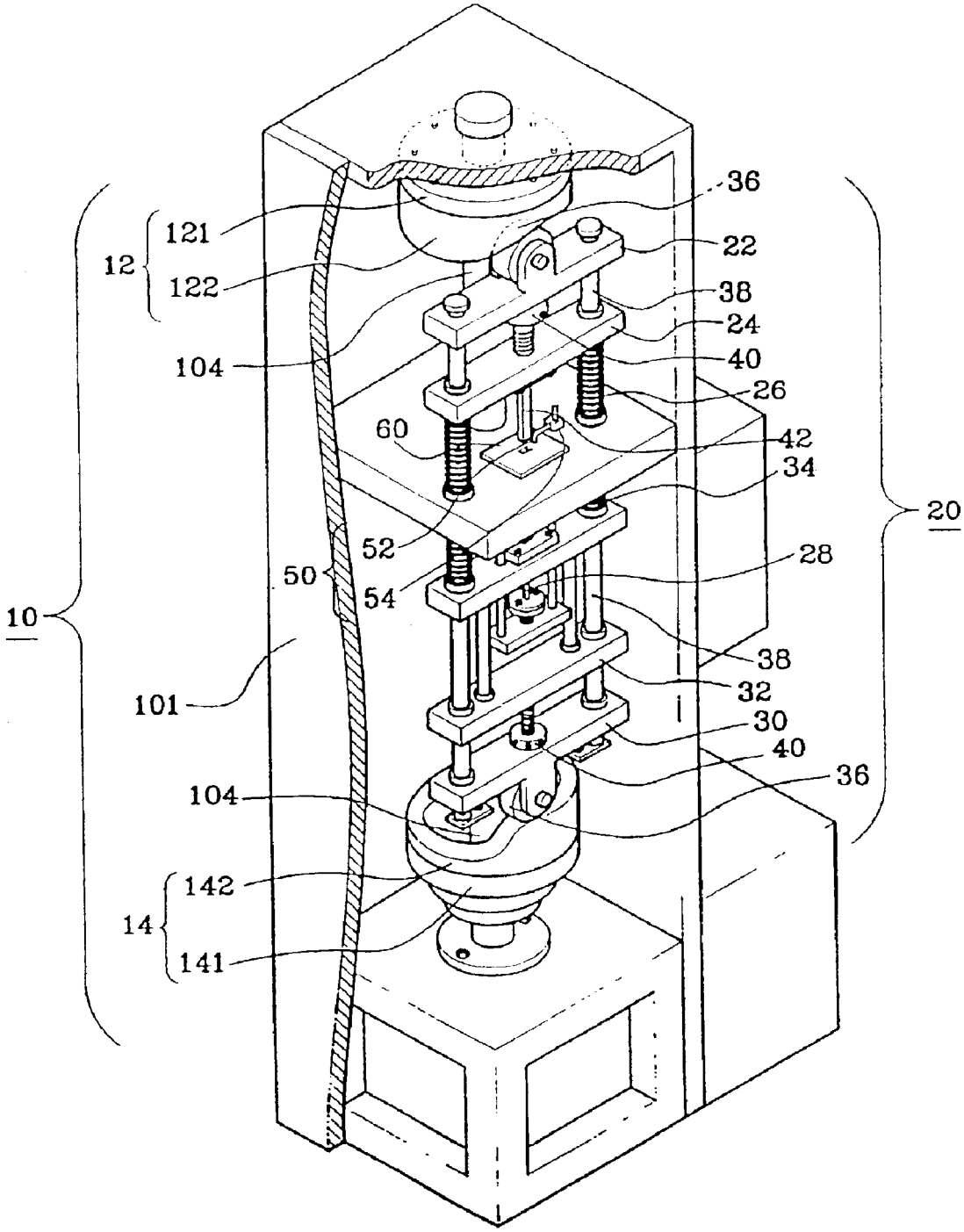
FIG. 2 is a perspective view a biaxial press molding system according to a preferred embodiment of the present invention.
Figure 3:
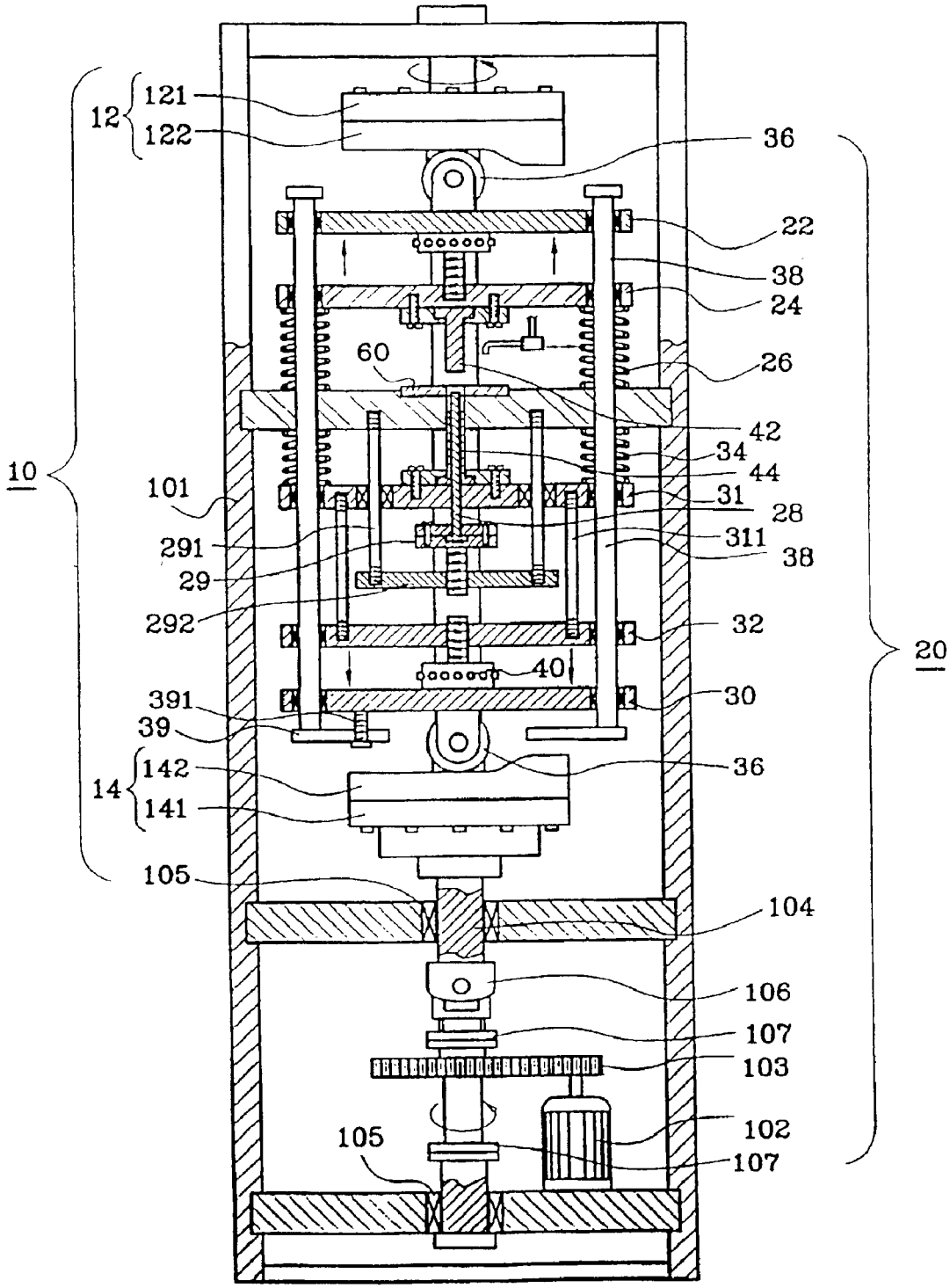
FIG. 3 is a sectional view showing a state in which the upper and lower punches of FIG. 1 are not operated.
Figure 4:
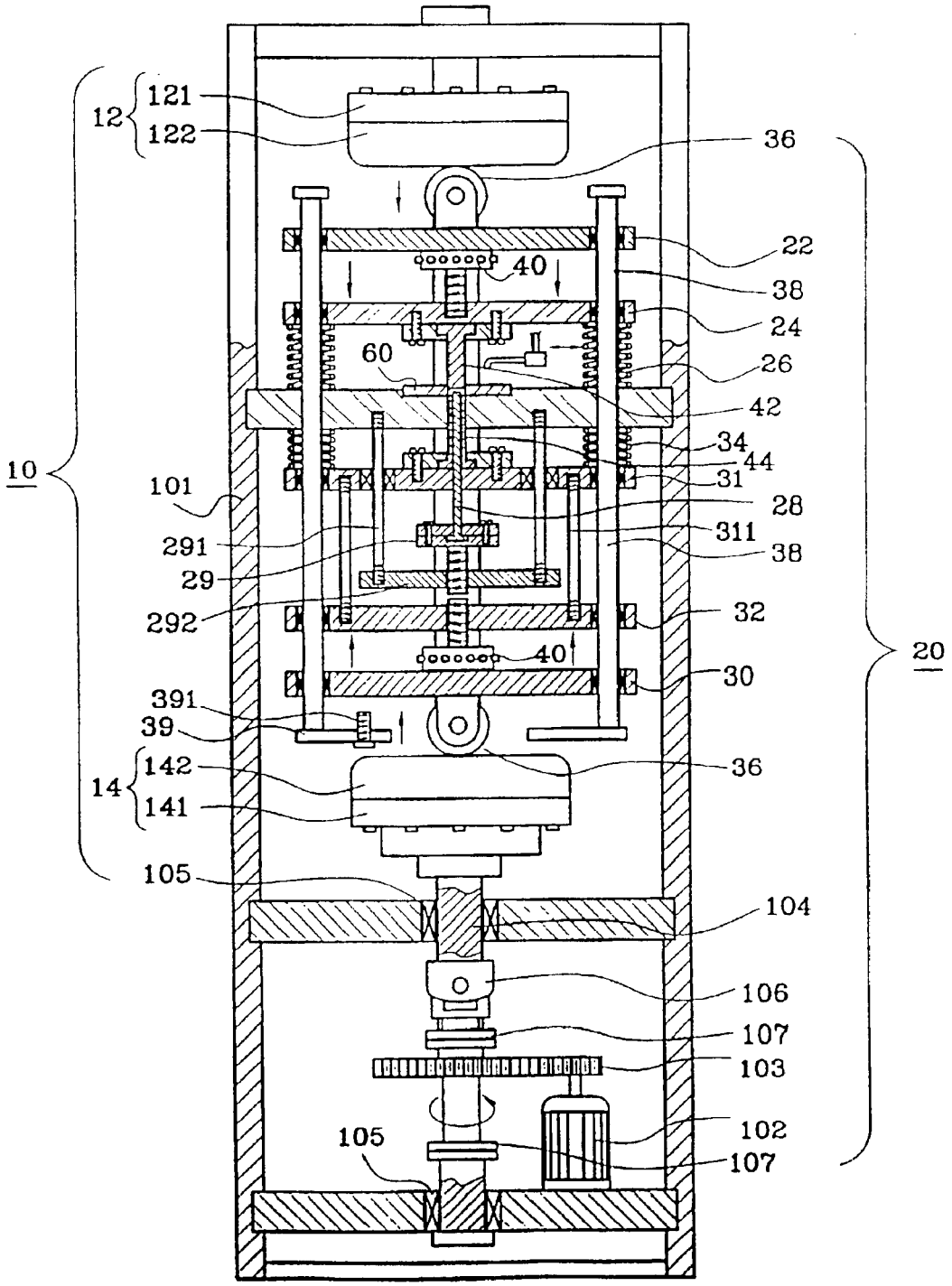
FIG. 4 is a sectional view showing a state in which the upper and lower punches of FIG. 1 are operated.

A biaxial press molding system for molding a part such as a ceramic cover having a flat upper surface and a concave lower surface among powder molding parts according to a preferred embodiment of the present invention is shown in FIGS. 2 through 4.

That is, as shown in FIGS. 2 through 4, the biaxial press molding system according to the preferred embodiment of the present invention includes a cam device 10, a biaxial press apparatus 20, and a powder supply and molded object transfer device 50.

Here, the cam device 10 includes an upper disc cam 12 and a lower disc cam 14 facing each other, a frame 101 constituting appearance and frame of the system, a motor 102 fixed at the lower portion of the frame 101, a reduction driven gear 103 for transferring a rotational force of the motor 102, a rotation shaft 104 which rotates at a speed decelerated by the reduction driven gear 103, is vertically erected, and is supported at the frame 101 via a bearing 105, a joint 106 for connecting the reduction driven gear 108 and the rotation shaft 104, and a coupling 107 installed at the reduction driven gear 103 and the rotation shaft 104 so that the reduction driven gear 103 can be replaced.

Also, the upper disc cam 12 and the lower disc cam 14 of the cam device 10 installed at the rotation shaft 104 rotate around the rotation shaft 104. The upper disc cam 12 includes an upper cam base 121 having a disc shape and horizontally formed at the upper portion of the rotation shaft 104 and a ring-shaped upper track member 122 screw-coupled to the lower surface of the upper cam base 121 and having upper and lower portions formed on the lower surface thereof. Also, the lower disc cam 14 includes an lower cam base 141 having a disc shape and horizontally formed at the lower portion of the rotation shaft 104 and a ring-shaped lower track member 142 screw-coupled to the upper surface of the lower cam base 141 and having upper and lower portions formed on the upper surface thereof.

As an apparatus installed between the upper disc cam 12 and the lower disc cam 14 to be capable of sliding-contact for converting the rotation motion of the upper disc cam 12 and the lower disc cam 14 to a linearly reciprocating motion and forming biaxial pressures to be applied to an object to be molded, the biaxial press apparatus 20 of the present invention includes an upper roller moving member 22, an upper punch moving member 24, an upper elastic member 26, a core 28, a lower roller moving member 30, a lower punch moving member 32, and a lower elastic member 34.

That is, a roller 36 contacting the upper and lower portions of the upper track member 122 is installed on the upper surface of the upper roller moving member 22. Through holes are formed at both end portions of the upper roller moving member 22 so that the upper roller moving member 22 can easily move up and down along guide rods 38 fixed to the frame 101.

A screw assembly 40 for adjusting pressure with respect to the upper roller moving member 22 is installed at the upper punch moving member 24. Through holes are formed at both end portions of the upper punch moving member 24 so that the upper punch moving member 24 can easily move up and down along the guide rods 38 fixed to the frame 101. The upper punch 42 is fixed to the lower surface of the upper punch moving member 24.

Also, the upper elastic member 26 is installed between the frame 101 and the upper punch moving member 24 and applies a return force in a direction in which the upper punch moving member 24 ascends.

The upper roller moving member 22, the upper punch moving member 24, and the upper elastic member 26 are disposed above the molded object while the core 28, the lower roller moving member 30, the lower punch moving member 32, and the lower elastic member 34 are disposed under the molded object.

That is, the core 28 pierces the center of the lower punch 44 and is fixed to the frame 101 so that the height can be adjusted. Also, in order for the core 28 to pierce the lower punch 44, the core fixing portion is installed under the lower punch fixing portion and supported by a plurality of support rods 291 extending from the frame 101 and a support plate 292, which forms an assembly structure. Thus, to adjust the height of the core 28, a core screw assembly 29 is rotated to determine the specification of the molded object.

Also, a roller 36 contacting the upper and lower portions of the lower track member 142 is installed on the lower surface of the lower roller moving member 30. Since Through holes are formed at both end portions of the lower roller moving member 30, the lower roller moving member 30 can freely move up and down along the guide rods 38 fixed to the frame 101 so that the amount of powder to be filled for molding and the position for escaping from a mold after pressing are determined.

Here, as shown in FIGS. 3 and 4, the amount of powder to be filled is determined by the lower roller moving member 30 receiving a return force in a downward direction of the lower elastic member 34 and simultaneously by a filling amount adjusting screw 391 screw-fixed to a fixed plate 39.

Also, to adjust the distance and pressure with respect to the lower roller moving member 30, a screw assembly 40 is installed on the lower surface of the lower punch moving member 32 and connected by the support rods 311. The core 28 pierces the lower punch 44 so that a fixing portion of the lower punch 44 is installed above a fixed portion of the core 28.

Thus, the core 28 is fixedly supported at the frame so that the height of the upper surface thereof can be adjusted. The lower punch 44 is manufactured to encompass the core 28 so that the lower punch 44 can be moved up and down, independently from the core 28, by the lower roller 36 which moves up and down along the lower disc cam 14.

Also, the lower elastic member 34 is installed between the frame 101 and an extension plate 31 and generates a return force in a direction in which the extension plate 31 and the lower punch moving member 32 fixedly connected to the extension plate 31 are prevented from ascending.

Here, the upper elastic member 26 and the lower elastic member 34 enable the upper roller moving member 22, the upper punch moving member 24, the lower roller moving member 30, and the lower punch moving member 32 to perform stable upward and downward movements without clearance. Also, the upper elastic member 26 and the lower elastic member 34 have the upper and lower rollers 36 always contact the upper disc cam 12 and the lower disc cam 14 when pressed.

Here, the upper pressure and lower pressure can be controlled by changing the distance between each roller 36 and each of the upper and lower punches 42 and 44 by rotating the upper and lower screw assemblies 40 attached to the upper roller moving member 22, respectively, so as to have screws advance and retreat.

Also, the amount of filling is can be controlled by changing the lowering distance of the lower punch 44 by rotating the filling amount adjusting screw 391, so that the amount of powder provided in a space between the die and the lower punch 44. Also, the height of the core 28 can be adjusted by rotating the core screw assembly 29 so that the amount of powder to be filled and the amount of pressure to be applied can be changed.

Here, for demold of the molded object and filling of material for molding, upper and lower portions can be formed at the lower track member 142 and, although not shown, various kinds of screw advancing and retreating apparatuses or fixing apparatuses can be used as a height adjusting means of a cam where the upper and lower portions is formed.

The powder supply and molded object transfer apparatus 50 of the present invention supplies material for molding, such as ceramic powder, powdered resin or solid resin, to a die 60 installed at an intermediary panel of the frame 101. The powder supply and molded object transfer apparatus 50 includes a powder supply pipe 52 capable of linearly reciprocating so that it can stay in a ready region while the upper punch 42 and the lower punch 44 linearly reciprocates. A powder supply pipe transfer apparatus 54 for reciprocating the powder supply pipe 52 enables a sequential work by directly connecting the powder supply pipe transfer apparatus 54 and the powder supply pipe 52 by using a disc rotation shaft and a gear chain.

The powder supply and molded object transfer apparatus 50 can adopt various types and shapes of powder supply apparatuses and molded object transfer apparatuses. This molded object supply technology is well known and easily changed and modified by those skilled in the art.

Figure 5:
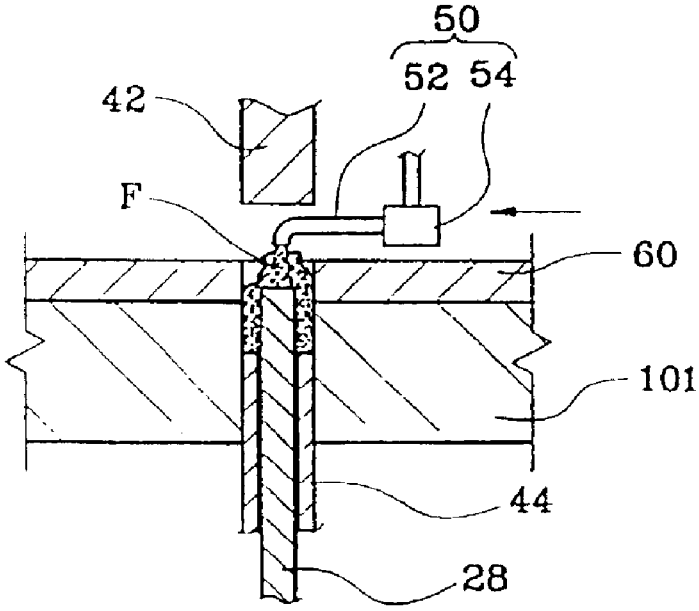
FIGS. 5 through 7 are enlarged sectional views showing the process of applying biaxial pressure to an object to be pressed.

Thus, in the description of the operation of the biaxial press molding system according to a preferred embodiment of the present invention, as shown in FIG. 5, the powder supply and molding object transfer apparatus 50 advances so that powder is supplied to the die 60 and then retreats to a standby position where the powder supply and molding object transfer apparatus 50 stays.

Next, the rotational force of the motor 102 of FIG. 2 is decelerated by the reduction driven gear 103 and transferred to the rotation shaft 104. When the rotation shaft 104 rotates, the upper disc cam 12 and the lower disc cam 14 formed on the rotation shaft 104 rotate at the same speed.

Figure 6:
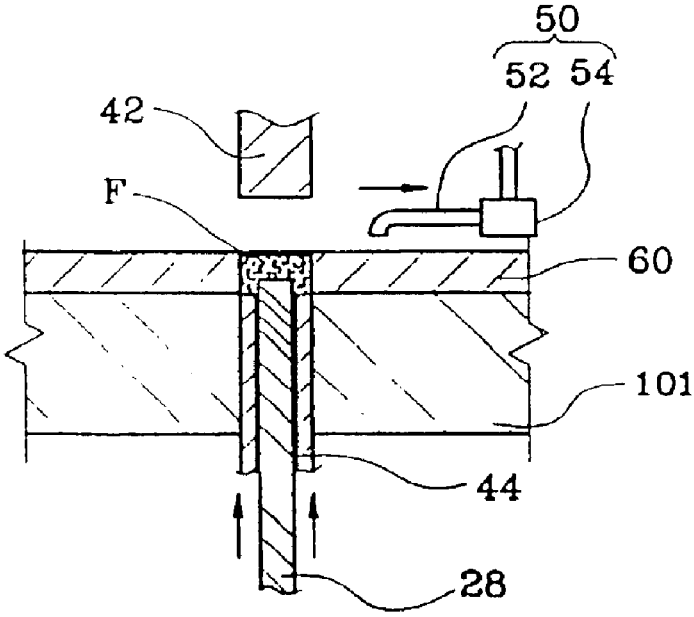

Here, when the roller 36 of the lower roller moving body 30 ascends while contacting the mountain of the lower track member 142 of the lower disc cam 14, the lower track member 142 ascends together. As the lower punch moving body 32 ascends together with the lower track member 142, as shown in FIG. 6, the lower punch 44 fixed to the lower punch moving body 32 ascends.

Figure 7:
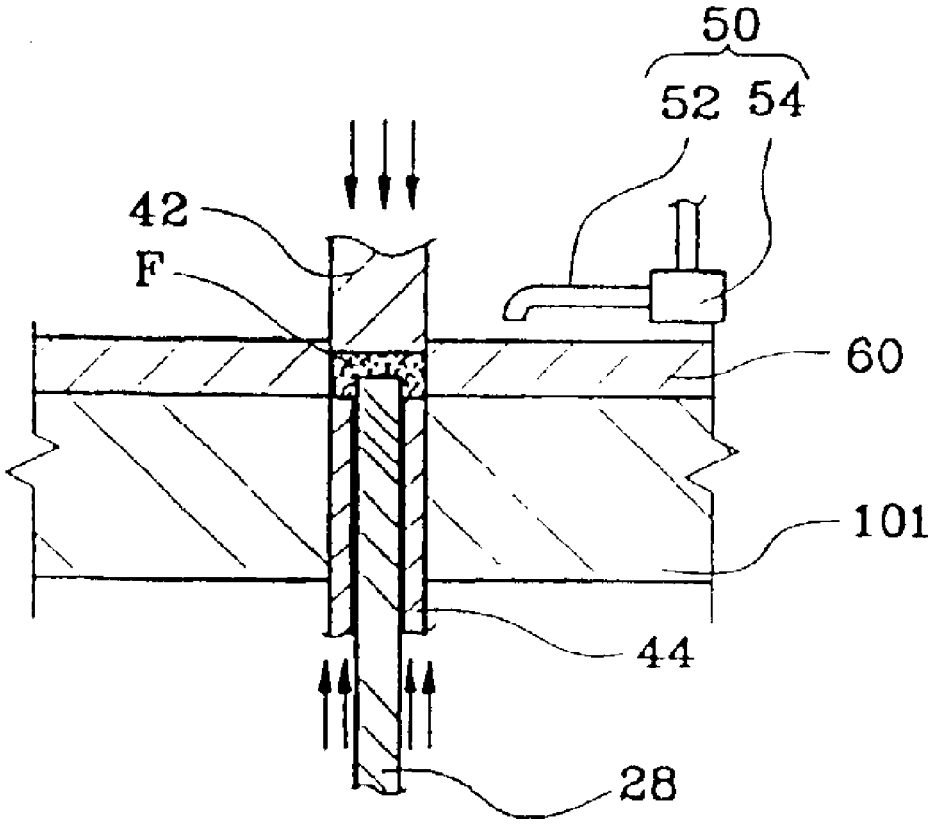

Next, when the roller 36 of the upper roller moving body 22 descends while contacting the mountain of the upper track member, the upper punch moving body 24 descends together and as shown in FIG. 7, the upper punch 42 descends.

Figure 8:
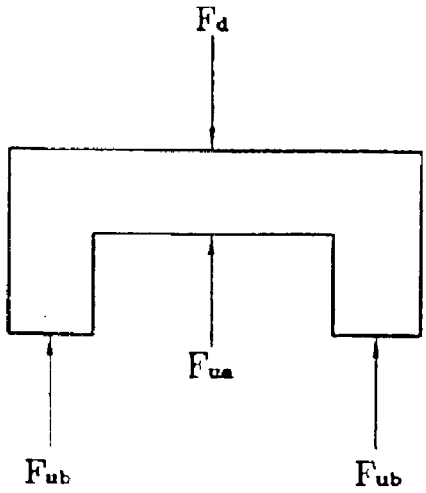
FIG. 8 is a view showing the biaxial pressure shown in FIG. 7.
Figure 9:
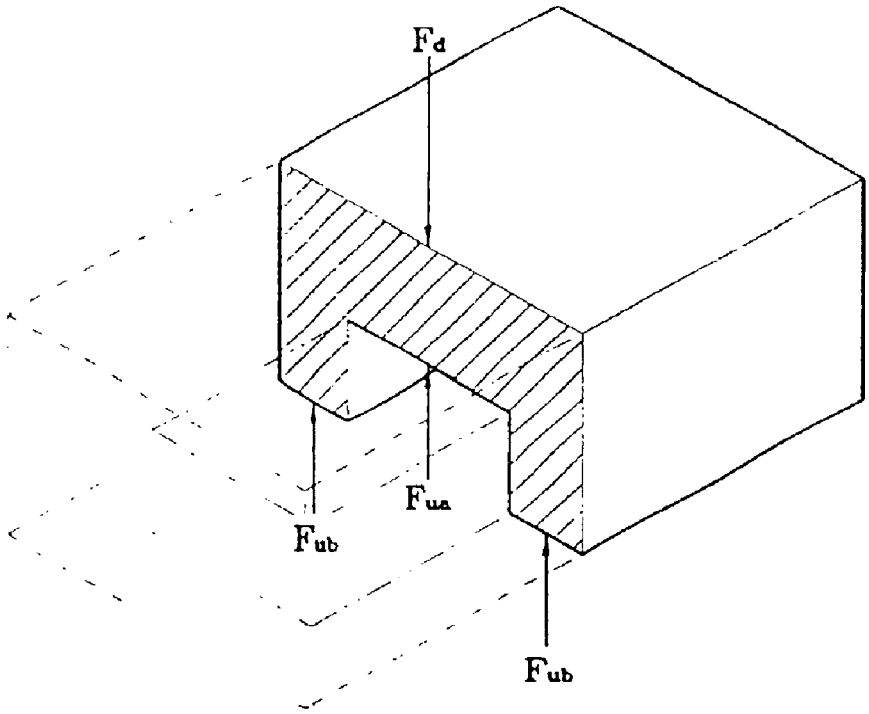
FIG. 9 is a partially cut-away perspective view a pressed object by the biaxial press molding system of the present invention.

Thus, as shown in FIGS. 8 and 9, since a molding object receives biaxial pressures by the upper punch 42 and the lower punch 44, the molding object is formed with an entirely uniform density.

That is, a pressing force (Fd) applied by the upper punch 42 to the molding object is generated when the core 28 and the lower punch 44 ascend. To maintain a uniform molding density at the center and outer portions of the molding object, pressure (Fua) at the core portion and pressure at the outer portion (Fub) should be adjusted independently. The molding object, which is manufactured by finely adjusting the lower pressing force (Fua) and the pressing force (Fub) by using the biaxial press molding system of the present invention, has a uniform molding density. Thus, it is possible to manufacture fine precision products which are not warped or twisted in the subsequent steps such as sintering.

In addition, the biaxial press molding system according to the present invention can manufacture various types of molding objects to which biaxial pressure is applied, by manufacturing various types and shapes of the upper and lower punches and the core.

The mountains and furrows of the upper and lower track members 122 and 142 can be variously changed according to the point of generation of biaxial pressure and the amount of pressure. Also, by manufacturing upper and lower track members having various shapes in advance, the upper and lower track members suitable for work are screw-coupled to the upper cam base 121 and the lower cam base 14, respectively.

The biaxial press molding system of the present invention may further include a loading/unloading apparatus for separating a molding object from the die. Since such added apparatuses are well known and have been widely used, detailed descriptions thereof will be omitted.

In the biaxial press apparatus of the biaxial press molding system of the present invention, other various structure other than the above-described structure are possible in which the upper and lower punches may be independently operated and the lowering distance of the lower punch and the height of the core can be adjusted. Another preferred embodiment of the biaxial press apparatus is shown in FIGS. 10 through 12.

Figure 10:
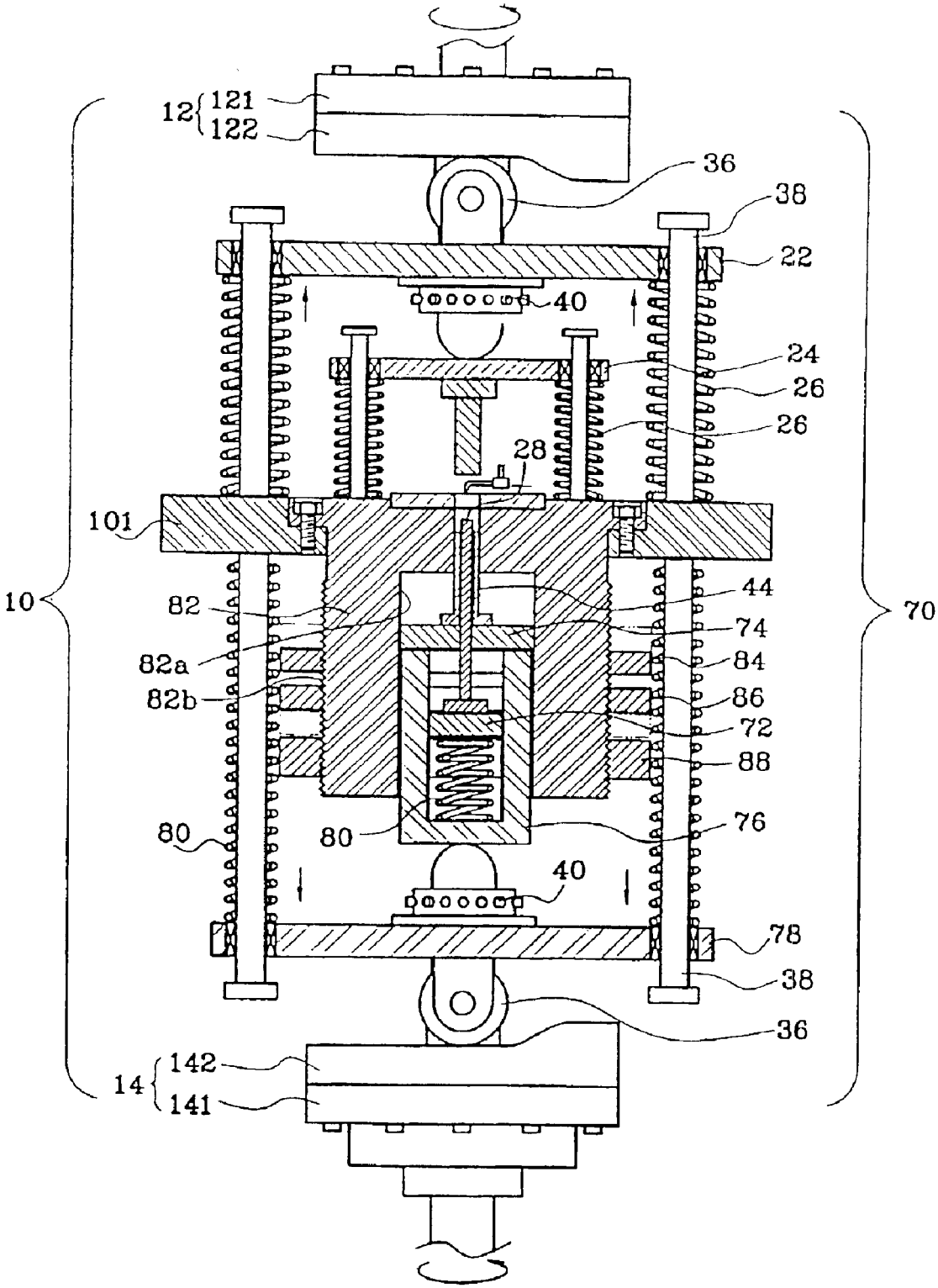
FIG. 10 is a sectional view showing a state in which the upper and lower punches according to another preferred embodiment of the present invention are not operated.
Figure 11:
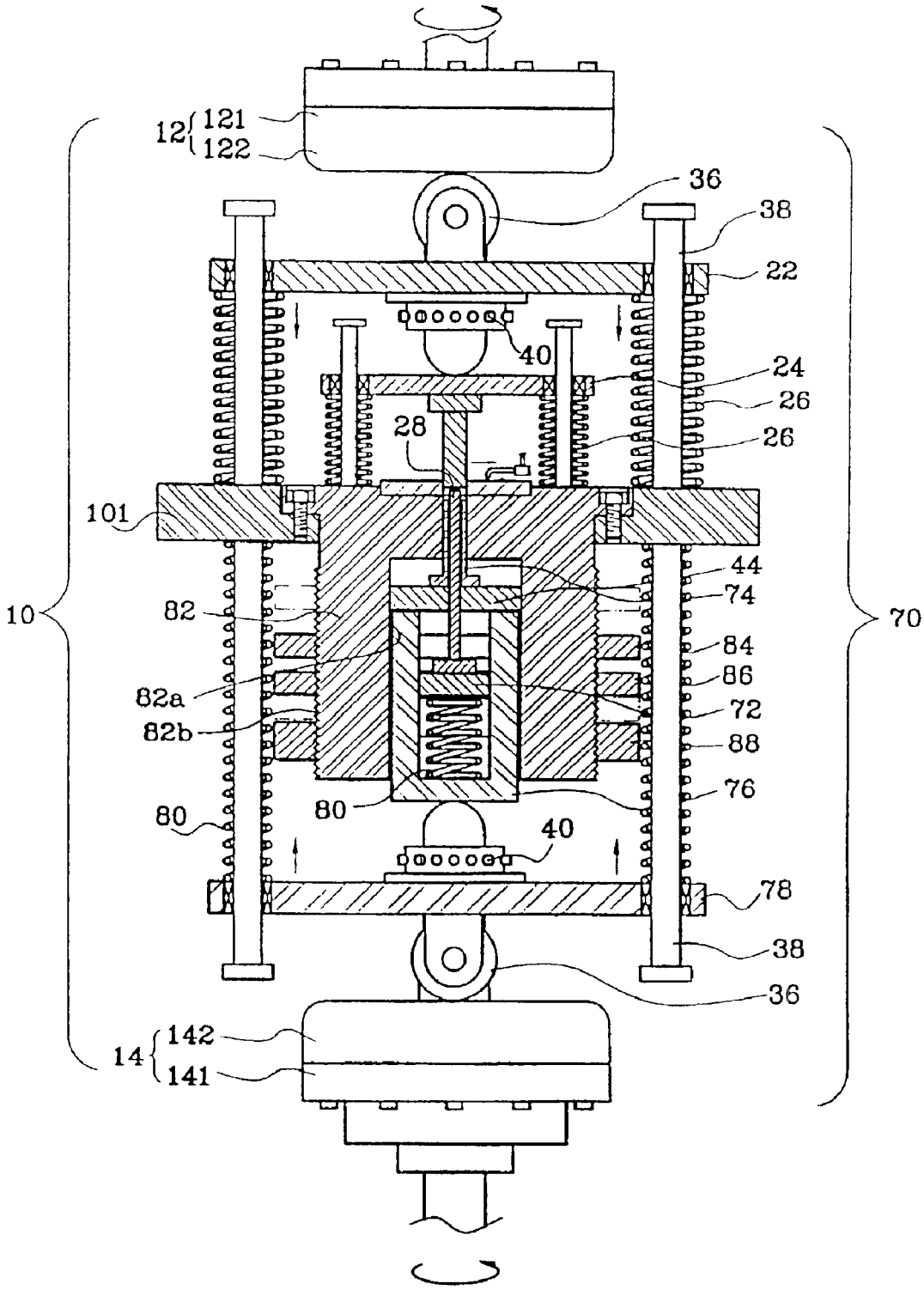
FIG. 11 is a sectional view showing a state in which the upper and lower punches of FIG. 10 are operated.
Figure 12:
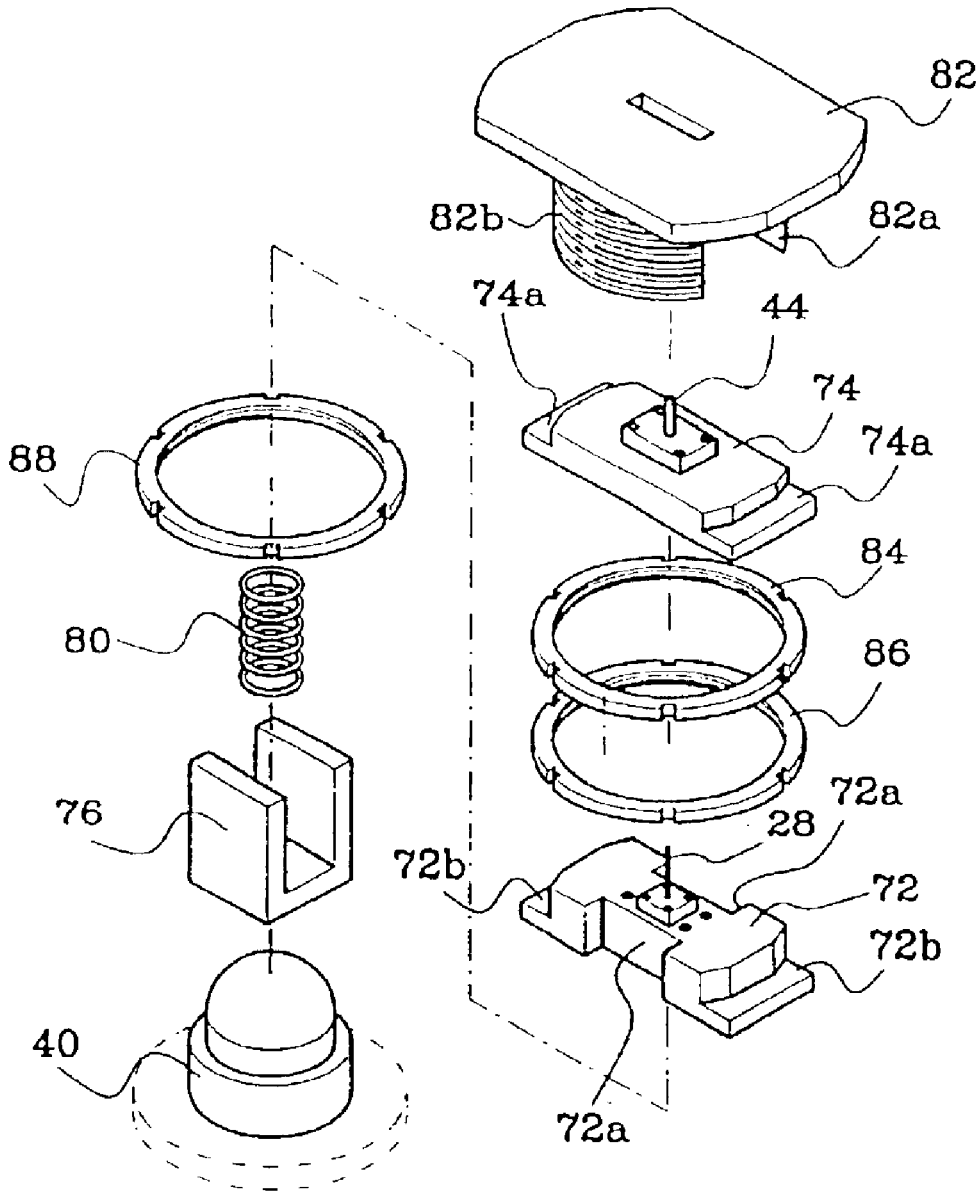
FIG. 12 is an exploded perspective view showing parts the guide member, the core fixing plate, the lower punch moving plate, the push unit, the lower roller moving member, and the lower elastic member of the biaxial press molding system of FIG. 10.

That is, as shown in FIGS. 10 through 12, a biaxial press apparatus 70 includes an upper roller moving body 22, an upper punch moving body 24, an upper elastic member 26, a core 28, a core fixing plate 72, a lower punch moving plate 74, a pushing rod 76, a lower roller moving body 78, a lower elastic member 80, and a guide body 82. The basic structures of the upper roller moving body 22, the upper punch moving body 24, and the upper elastic member 26 are the same as those of the same elements described above. In particular, the guide body 82, the core fixing plate 72, the lower punch moving plate 74, and the pushing rod 76 are vertically stacked and independently sliding up and down while directly being engaged with the guide body 82.

That is, the guide body 82 is cylindrical having one side fixed to the frame 101 and the other side open, forming a groove 82*a*, and a screw-screw-threaded groove 82*b* is formed at the outer circumference thereof. Here, the groove 82*a* is preferably rectangular or cylindrical so that ascending and descending motion can be guided.

Also, in the lower punch moving plate 74, the lower punch 44 is fixed on the upper surface thereof and the center portion thereof closely contacts and is inserted into the groove 82*a* of the guide body 82. The lengths of both ends portions 74*a* of the lower punch moving plate 74 which is a plate, as shown in FIG. 12, is greater than the diameter of the screw-screw-threaded groove 82*b* of the guide body 82.

Also, in the core fixing plate 72 that is a plate, the core 28 is fixed to the upper surface thereof and the center portion closely contacts and is inserted into the groove 82*a* of the guide body 82. Two grooves 72*a* are formed at both sides of the center portion in the lateral direction. The length of both end portions 72*b* are greater than the diameter of the screw-threaded groove 82*b* of the guide body 82.

Also, the push unit 76 has a U shape. Both upper end portions thereof are closely inserted into the groove 82*a* of the guide body 82 and simultaneously pass through the groove 72*a* of the core fixing plate 72, thus contacting the bottom surface of the lower punch moving plate 74.

Here, the core 28 installed at the core fixing plate 72 passes through the lower punch 44 installed at the lower punch moving plate 74. The lower punch 44 can move up and down by a vertical movement of the lower roller moving body 78, independent of the core 28.

That is, in the lower roller moving body 78, a roller 36 contacting the upper and lower portions of the lower track member 142 is installed at the lower surface thereof. A through hole is formed at both end portions thereof so that the lower roller moving body 78 can freely move up and down along the guide rod 38 fixed to the frame 101. A screw assembly 40 is installed on the upper surface of the lower roller moving body 78 so that the distance from the push unit 76 and pressure can be adjusted.

In the lower punch ascending and descending motion of the biaxial press apparatus 70, as shown in FIG. 11, when the roller 36 of the lower roller moving body 30 ascends while contacting the mountain of the lower track member 142 of the lower disc cam 14, the lower roller moving body 78 ascends together. As the push unit 76 ascends together by the lower roller moving body 78, the push unit 76 ascends the lower punch moving plate 74 and the lower punch 44 fixed to the lower punch moving late 74 ascends.

Here, since the lower punch moving plate 74 is a plate and the lengths of both end portions 74*a* thereof are greater than the diameter of the screw-threaded groove 82*b* of the guide body 82, the amount of powder for a molding object filled on the lower punch 44 can be adjusted by a lower punch lowering height limiting screw ring 84 that is screw-coupled to the screw-threaded groove 82*b* corresponding to the diameter of the outer circumference of the screw-threaded groove 82*b*.

That is, as shown in FIG. 10, the lowering height of the lower punch moving plate 74 is limited when the both end portions 74*a* thereof is lowered together with the push unit 76 and the both end portions are stopped by the lower punch lowering height limiting screw ring 84. Thus, a user can adjust the amount of powder to be filled for a molding object by adjusting the lowering height of the lower punch 44 by rotating the lower punch lowering height limiting screw ring 84.

Since the core fixing plate 72 is a plate and the lengths of the both end portions 72*b* thereof are greater than the diameter of the screw-threaded groove 82*b* of the guide body 82, the height of the fixed core 28 can be adjusted by the upper core fixing screw ring 86 and the lower core fixing screw ring 88 screw-coupled to the screw-threaded groove 82*b* corresponding to the diameter of the screw-threaded groove 82*b* of the outer circumferential surface of the guide body 82.

That is, as shown in FIGS. 10 through 12, the height of the core fixing plate 72 is fixed by being pressed by the upper core fixing screw ring 86 and the lower core fixing screw ring 88 in the upward and downward directions. Thus, to adjust the height of the core 28, a user can determine the specification of a molding object by rotating the upper core fixing screw ring 86 and the lower core fixing screw ring 88.

Also, the lower elastic member 80 is disposed between the push unit 76 and the core fixing plate 72 fixed by the upper and lower core fixing screw rings 86 and 88 to apply a return force in a direction in which the push unit 80 is lowered.

Fine adjustment of the upper or lower pressure is made by using the upper and lower screw assemblies 40 attached to the upper and lower roller moving bodies 22 and 78. Also, an additional guide rod can be installed to improve a degree of precision in upward and downward movements of the core fixing plate 72 and the lower punch moving plate 74.

While this invention has been particularly shown and described with reference to preferred embodiments thereof, it will be understood by those skilled in the art that various changes in form and details may be made therein without departing from the spirit and scope of the invention as defined by the appended claims.

For example, although various preferred embodiments such as the structure of the assembly frame using the support rod or the stacked type and engaged sliding structure are suggested in the above-described present invention, various types of structures which enable the upper and lower punches to move up and down independent of each other and ascending and descending or adjustment of the fixed height thereof can be used.

As described above, in the biaxial press molding system according to the present invention, since the amount of impact of the punch or a pressing force and load concentrate on the rotation shaft by using the disc cam facing each other and rotating by being caught by the rotation shaft, an optical design and light weight of the frame is possible. Since the rotation speed of the two cams can be controlled by a single motor and rotation shaft, rapid and accurate control is possible. Since the mounting and furrow is formed on the frictional surface of each cam, the biaxial pressure continuously applied to a molding object can be freely and separately adjusted. Since control of pressure according to the position and time of the molding object is possible, extremely fine parts can be mass-produced. Since a die set module is externally coupled, mold can be easily detached/attached. Also, the coupling time and the accuracy can be improved during assembly of a complicated mold. Since unnecessary space can be removed compared to the conventional die set, the length of the mold such as the core, the lower punch, and the upper punch can be reduced so that manufacturing thereof can be made easy.

What is claimed is:

1. A biaxial press molding system comprising:

a frame;

a rotation shaft being rotatably supported on the frame;

a motor fixed to the frame for rotatively driving the rotation shaft;

a die for inserting an object to be pressed;

an upper cam installed at the rotation shaft which includes upper and lower portions formed on a lower surface thereof, the upper portion extending toward the die to a greater extent than the lower portion, the upper and lower portions being part of a first continuous contact surface of fixed configuration that extends along the lower surface in a generally annular fashion;

an upper roller being capable of slide contacting with the first continuous contact surface of the upper cam, when the upper cam rotates, the upper portion of the first continuous contact surface drives the upper roller generally downwardly and the lower portion of the first continuous contact surface allows the upper roller to move generally upwardly;

an upper punch moving up and down corresponding to the movement of the upper roller so that a pressure can be applied to the upper side of the object to be pressed;

a lower cam installed at the rotation shaft which includes upper and lower portions formed on an upper surface thereof, the upper portion extending toward the die to a greater extent than the lower portion, the upper and lower surfaces being part of a second continuous contact surface of fixed configuration that extends along the upper surface in a generally annular fashion;

a lower roller being capable of slide contacting with the second continuous contact surface of the lower cam, when the lower cam rotates, the upper portion drives the lower roller generally upwardly and the lower portion allows the lower roller to move generally downwardly; and a lower punch moving up and down corresponding to the movement of the lower roller so that a pressure can be applied to the lower side of the object to be pressed.

2. The biaxial press molding system as claimed in claim 1, wherein the upper cam are disc cam and includes an upper cam base of disc shape and a ring-shaped upper track member coupled to the lower surface of the upper cam and having upper and lower portions formed on the lower surface thereof, wherein the lower cam are disc cam and includes a lower cam base of disc shape and a ring-shaped lower track member coupled to the upper surface of the lower cam and having upper and lower portions formed on the upper surface thereof.

3. A biaxial press molding system comprising:

a cam apparatus having cams facing each other; and a biaxial press apparatus, disposed between the cams and installed to be capable of sliding contacting the cams, for forming a biaxial pressure to a molding object by converting rotational motion of the cams to linear reciprocating motion;

wherein the cam apparatus comprises:

a frame;

a motor fixed to the frame;

a reduction driven gear for transferring a rotational force of the motor;

a rotation shaft rotating at a speed decelerated by the reduction driven gear and being supported at the frame via a bearing;

a joint for connecting the reduction driven gear and the rotation shaft;

an upper disc cam including a disc type upper cam base formed at the upper end portion of the rotation shaft and a ring type upper track member screw-coupled to the lower surface of the upper cam base and having upper and lower portions formed on the lower surface thereof; and a lower disc cam including a disc type lower cam base formed at the lower end portion of the rotation shaft and a ring type lower track member screw-coupled to the upper surface of the lower cam base and having upper and lower portions formed on the upper surface thereof;

wherein the biaxial press apparatus comprises:

an upper roller moving body in which a roller contacting the upper and lower portions of the upper track member of the upper disc cam is installed on the upper surface thereof and a through hole is formed at each of both end portions thereof so that the upper roller moving body freely moves up and down along a guide rod fixed to the frame;

an upper punch moving body in which a screw assembly for adjusting pressure and the distance from the upper roller moving body is installed on the upper surface thereof, a through hole is formed at each of both end portions so that the upper punch moving body freely moves up and down along the guide rod fixed to the frame, and an upper punch is fixed to the lower surface thereof;

an upper elastic member installed between the frame and the upper punch moving body for applying a return force in a direction in which the upper punch moving body ascends;

a core passing through the center of the lower punch and fixed to the frame to be capable of the height thereof being adjusted;

a lower roller moving body in which a roller contacting the upper and lower portions of the lower track member is installed on the lower surface thereof and a through hole is formed at each of both end portions thereof so that the lower roller moving body freely moves up and down along the guide rod fixed to the frame;

a lower punch moving body in which a screw assembly for adjusting pressure by adjusting the distance from the lower roller moving body is installed on the lower surface thereof, a through hole is formed at each of both end portions so that the lower punch moving body freely moves up and down along the guide rod fixed to the frame, and a lower punch is fixed to the upper surface thereof; and a lower elastic member installed between the frame and the lower roller moving body for applying a return force in a direction in which the lower punch moving body ascends.

4. A biaxial press molding system comprising:

a cam apparatus having cams facing each other; and a biaxial press apparatus, disposed between the cams and installed to be capable of sliding contacting the cams, for forming a biaxial pressure to a molding object by converting rotational motion of the cams to linear reciprocating motion;

wherein the cam apparatus comprises:

a frame;

a motor fixed to the frame;

a reduction driven gear for transferring a rotational force of the motor;

a rotation shaft rotating at a speed decelerated by the reduction driven gear and being supported at the frame via a bearing;

a joint for connecting the reduction driven gear and the rotation shaft;

an upper disc cam including a disc type-upper cam base formed at the upper end portion of the rotation shaft and a ring type upper track member screw-coupled to the lower surface of the upper cam base and having upper and lower portions formed on the lower surface thereof; and a lower disc cam including a disc type lower cam base formed at the lower end portion of the rotation shaft and a ring type lower track member screw-coupled to the upper surface of the lower cam base and having upper and lower portions formed on the upper surface thereof;

wherein the biaxial press apparatus comprises:

an upper roller moving body in which a roller contacting the upper and lower portions of the upper track member of the upper disc cam is installed on the upper surface thereof and a through hole is formed at each of both end portions thereof so that the upper roller moving body freely moves up and down along a guide rod fixed to the frame;

an upper punch moving body in which a screw assembly for adjusting pressure and the distance from the upper roller moving body is installed on the upper surface thereof, a through hole is formed at each of both end portions so that the upper punch moving body freely moves up and down along the guide rod fixed to the frame, and an upper punch is fixed to the lower surface thereof;

an upper elastic member installed between the frame and the upper punch moving body for applying a return force in a direction in which the upper punch moving body ascends;

a core passing through the center of the lower punch and fixed to a core fixing plate coupled to the frame to be capable of the height thereof being adjusted;

a cylindrical guide body having a hole of which one side is fixed to the frame and the other side is open and a threaded groove formed at the outer circumference thereof;

a lower punch moving plate having a plate shape in which a lower punch is fixed to the upper surface thereof, the center portion thereof is closely inserted in a groove of the guide body, and the length of each of both end portions is greater than the diameter of the threaded groove of the guide body;

a core fixing plate having a plate shape in which the core is fixed to the upper surface thereof, the center portion thereof is closely inserted in the groove of the guide body and simultaneously a grove is formed at both sides of the center portion in a lengthwise direction, and the length of each of both end portions thereof is greater than the threaded groove of the guide body;

a push unit substantially having a U shape in which the upper portion of each of both end portions thereof is closely inserted in the groove of the guide body and simultaneously passing through the groove of the core fixing plate to contact the lower surface of the lower punch moving plate;

a lower roller moving body in which a roller contacting the upper and lower portions of the lower track member is installed on the lower surface thereof, a through hole is formed at each of both end portions thereof so that the lower roller moving body freely moves up and down along the guide rod fixed to the frame, and a screw assembly is installed at the upper surface thereof to adjust pressure and the distance from the push rod;

a lower elastic member installed between the push unit and the core fixing plate for applying a return force in a direction in which the push unit descends;

upper and lower core fixing screw rings screw-coupled to the threaded groove to adjust the height of the core; and a lower punch lowering height limiting screw ring screw-coupled to the threaded groove to adjust the amount of powder for a molding object filled on the lower punch.

5. The biaxial press molding system as claimed in claim 4, wherein the groove is rectangular or cylindrical.

6. The biaxial press molding system as claimed in claim 3, wherein the upper and lower portions of each of the upper and lower track members is manufactured according to the point of generation of biaxial pressure and the amount of pressure required for a molding object, the upper and lower portions is formed at the lower track member for demolding of a molding object and filling with material for molding, and a height adjustment unit of the cam where the upper and lower portions is formed is further provided.

7. The biaxial press molding system as claimed in claim 1, further comprising a molding object supply unit for supplying material for molding to the die.

8. The biaxial press molding system as claimed in claim 4, wherein the upper and lower portion of each of the upper and lower track members is manufactured according to the point of generation of biaxial pressure and the amount of pressure required for a molding object, the upper and lower portions is formed at the lower track member for demolding of a molding object and filling with material for molding, and a height adjustment unit of the cam where the upper and lower portions is formed is further provided.

9. The biaxial press molding system as claimed in claim 1, wherein the upper and lower portions formed on the lower surface of the upper cam and the upper surface of lower cam are manufactured so that a biaxial pressure applied to an upper and lower sides of an object to be pressed can be maintained for an appropriate time at the maximum point.

* * * * *